United States Patent [19]

Roberts et al.

[11] Patent Number: 4,808,278

[45] Date of Patent: Feb. 28, 1989

[54] METHOD AND APPARATUS FOR PRODUCING ONE-SIDE ELECTROPLATED STEEL STRIP WITH ENHANCED PHOSPHATABILITY

[75] Inventors: Timothy R. Roberts, Middletown; David M. Smith, Fairfield; Alan F. Gibson, Middletown; Douglas J. Robbins, Hamilton, all of Ohio

[73] Assignee: Armco Inc., Middletown, Ohio

[21] Appl. No.: 144,216

[22] Filed: Jan. 15, 1988

[51] Int. Cl.[4] ..... C25D 7/06

[52] U.S. Cl. ..... 204/28; 204/34

[58] Field of Search ..... 204/28, 34

[56] References Cited

U.S. PATENT DOCUMENTS 4,464,232 8/1984 Wakano et al. ..... 204/28
4,609,594 9/1986 Odashima et al. ..... 428/629
4,632,733 12/1986 Jinba et al. ..... 204/28
4,708,779 11/1987 Fountoulakis et al. ..... 204/27

FOREIGN PATENT DOCUMENTS 37192 3/1983 Japan .
13593 1/1987 Japan .
13595 1/1987 Japan .

*Primary Examiner*—T. M. Tufariello
*Attorney, Agent, or Firm*—R. J. Bunyard; R. H. Johnson; L. A. Fillnow

[57] ABSTRACT

Producing one-side zinc electroplated strip having enhanced phosphating characteristics. Prior to electroplating, the non-electroplated side of the steel strip is cathodically pickled. Cathodic pickling minimizes staining and etching to the non-electroplated strip surface by the zinc electrolyte during electroplating of the opposite strip surface.

13 Claims, 6 Drawing Sheets

METHOD AND APPARATUS FOR PRODUCING ONE-SIDE ELECTROPLATED STEEL STRIP WITH ENHANCED PHOSPHATABILITY

BACKGROUND OF THE INVENTION

This invention relates to the production of one-side electroplated steel coiled strip or sheets with the non-electroplated side having good conversion coating characteristics. Hereafter, coiled strip or sheets will be collectively referred to as strip.

The term one-side electroplated strip means a steel strip having a metallic coating electroplated onto one side of the strip while the opposite side of the strip is free from the electroplated metallic coating. The opposite side free from metallic coating hereafter will be referred to as the non-electroplated side to distinguish it from the electroplated side even though the non-electroplated side may have a thin electroplated metallic coating temporarily deposited thereon during the process of this invention.

One-side electroplated strip is extensively used in the automotive industry with the non-electroplated surface becoming a painted exposed surface and the electroplated surface having good corrosion resistant characteristics. Prior to painting, the non-electroplated surface is pretreated to improve paint adhesion. This pretreatment or chemical conversion treatment is usually a phosphate coating.

As is well known, the surface to be electroplated must be cleaned to remove dirt, oil film and the like. This cleaning is accomplished by alkaline cleaning followed by pickling. Although immersion pickling could be used, this invention is limited to electrolytic pickling because the latter is more efficient. Electrolytic pickling includes using one or more pairs of electrodes positioned on each side of a passing strip. These electrodes normally are cathodes. When several pairs of electrodes are used such as in a vertical pickling unit, one or more of the pairs may be anodes. Hydrogen or oxygen gas forms at the strip surface which tends to scrub and more thoroughly clean the steel strip.

After being cleaned, the steel strip is passed through the electroplating unit containing one or more electroplating cells. Current flows between one or more electrodes and the strip surface causing metal to be deposited from the electrolyte onto one side of the strip. A yellow or dark stain caused by oxidation of the unplated surface by the electrolyte may form on the other side of the strip not electroplated. The non-electroplated side may also become etched by the electrolyte. This contamination and/or etching may result in uneven phosphate deposition and large phosphate crystals resulting in poor paint gloss, poor paint adherence and inferior corrosion resistance after painting. Good phosphating characteristics as defined by the automotive industry requires a uniform appearance of the phosphated surface, a dense microstructure i.e. crystal size <25 microns, and a smooth or unetched surface.

There have been various suggestions for removing the stain and preventing etching of the non-electroplated surface. U.S. Pat. No. 4,632,733 discloses wetting the stained surface with a weak acid and a saturated monovalent alcohol. The wetted surface is then abraded using a grit coated brush to remove the stain. U.S. Pat. No. 4,464,232 discloses slightly plating the non-electroplated side while electroplating the other side. After electroplating, electrolysis is applied to the non-electroplated side to remove the thin plating metal. Thus, deposition of corrosion products to the non-electroplated side from the electrolyte is prevented. U.S. Pat. No. 4,609,594 discloses electroplating one side of a steel strip with a plating metal followed by plating the non-electroplated side with a layer of oxides. The oxide plated side is then given a cathodic treatment to remove the oxides thereby enhancing the phosphating properties. U.S. Pat. No. 4,708,779 discloses electroplating one side of a steel strip with zinc. A solution of bifluoride salt is applied to the non-electroplated side of the strip and followed by rinsing with a dilute caustic solution. Phosphatability of the non-electroplated side of the strip is enhanced.

Accordingly, there is a concern about the conversion coating characteristics of the non-electroplated surface of one-side electroplated strip. More particularly, a procedure is needed to prevent staining and etching of the non-electroplated surface by the plating electrolyte while electroplating the other strip surface. We have determined staining and etching of the non-electroplated surface of the strip can be minimized by cathodic pickling the non-electroplated surface immediately prior to electroplating. An anode is positioned in a pickling solution adjacent to the non-electroplated strip surface. Current is passed through the anode and applied to the non-electroplated surface thereby providing a surface which has excellent conversion coating characteristics.

BRIEF SUMMARY OF THE INVENTION

This invention relates to producing one-side electroplated steel strip with the non-electroplated side having excellent conversion coating characteristics. Prior to electroplating, the steel strip is cathodically pickled. The strip is passed through an acid bath including a pickling anode within the bath adjacent to the non-electroplated strip surface. Current is passed through the pickling anode and into the non-electroplated strip surface. The strip is then passed through an electroplating unit which includes a plating cell, an anode and a metal dissolved in an electrolyte. The surface of the strip to be electroplated is passed adjacent the plating anode. Current is passed through the plating anode thereby causing the metal to be deposited onto the one surface of the strip. The plated strip and/or parts subsequently produced from the strip are then passed through a conversion coating.

It is a principal object of this invention to use cathodic pickling prior to electroplating the opposite side of the strip to form a surface (the non-electroplated side of one-side electroplated steel strip) which exhibits enhanced phosphatability.

An advantage of our invention is formation of a steel surface that is neither stained nor etched by a plating electrolyte.

Another advantage is elimination of a post-treatment step to remove stains from the non-electroplated strip surface.

A further advantage is formation of a very smooth non-electroplated strip surface having excellent conversion coating characteristics.

The above and other objects, features and advantages of our invention will become apparent upon consideration of the detailed description and appended drawing.

DETAILED DESCRIPTION OF THE PREFERRED EMBODIMENT

Figure 1:
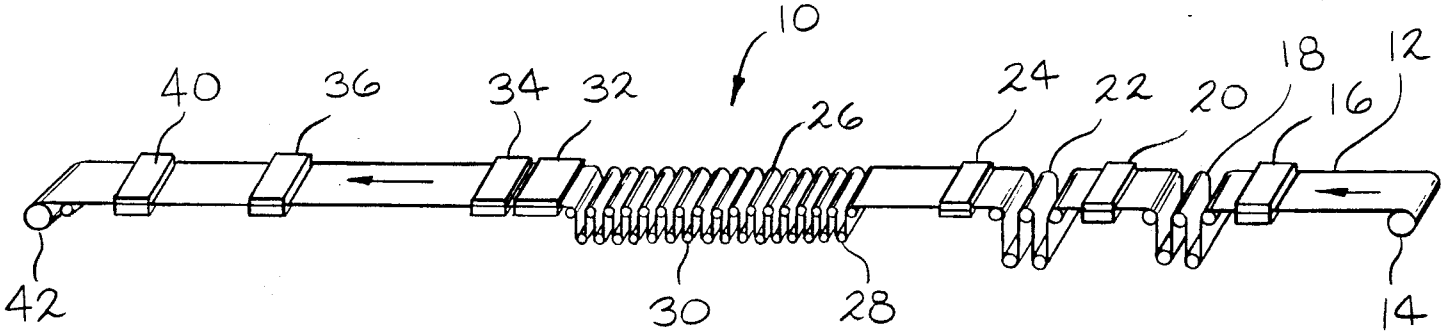
FIG. 1 is a schematic view of a one-side electroplating line incorporating our invention.

Referring now to FIG. 1, reference numeral 10 generally refers to an electroplating line. A steel strip 12 passes from an uncoiler 14 through a spray cleaner 16, an electrolytic cleaner 18, a water rinse 20, an electrolytic pickler 22 and another water rinse 24. After strip 12 has been given a preliminary cleaning treatment, it passes through an electroplating unit 26 where a coating metal is deposited onto only one side of strip 12. After electroplating, strip 12 is rinsed at a station 32 and dryed by a heater 34. Strip 12 is preferably rinsed with phosphoric acid at a station 36, dryed by a heater 40 and coiled by a recoiler 42. After electroplating, a conversion coating, e.g. zinc phosphate, is applied to the non-electroplated surface. Although this conversion coating could be applied to strip 12 on line 10, the conversion coating is normally applied to parts fabricated from strip 12.

Figure 2:
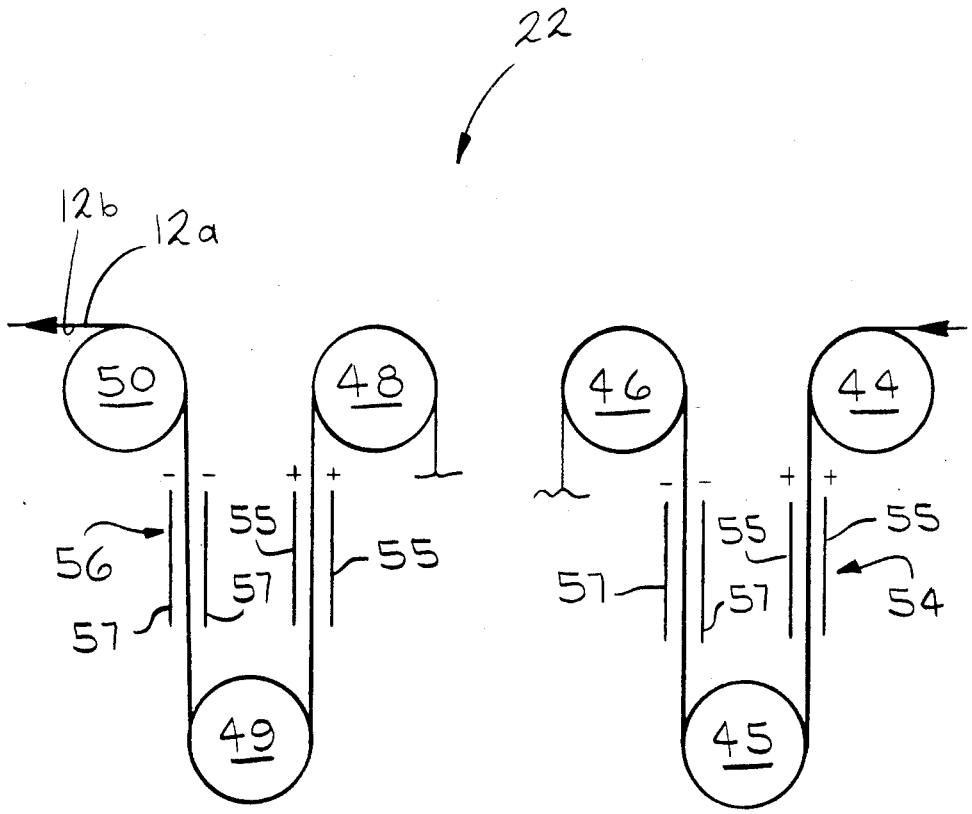
FIG. 2 is a schematic elevation view of a prior art electrolytic pickling unit.

FIG. 2 illustrates in detail a conventional electrolytic pickling unit 22. Pickling unit 22 can include one or more vertical pickling cells with two cells being shown. A first cell includes a pair of upper change of direction rollers 44,46 and a lower change of direction roller 45. A second cell includes upper rollers 48,50 and a lower roller 49. Strip 12 includes an upper surface 12*a* and a lower surface 12*b*. Hereafter, it will be understood surface 12*a* is to be the non-electroplated surface of strip 12 and surface 12*b* will become the electroplated surface of strip 12. As will be explained later, it will be also understood by those skilled in the art the roles of surfaces 12*a* and 12*b* could be reversed. Strip surface 12*b* to become electroplated with a coating metal must be cleaned of dirt, oil film and the like and is passed through a pickling operation containing sulfuric acid. A pair of electrodes of like polarity is positioned so that one electrode is positioned adjacent each side of strip 12 at each vertical location of travel. The polarity of the pair of electrodes is changed at successive vertical positions. For FIG. 2, a first pair 54 includes anodes 55 (positive) and a final pair 56 includes cathodes 57 (negative). This sequence of pickling can be referred to as anodic, cathodic, anodic meaning the polarity alternates between adjacent pairs of electrodes. Most importantly, surface 12*a* is exposed lastly to an anodic current at the completion of the pickling step.

Figure 3:
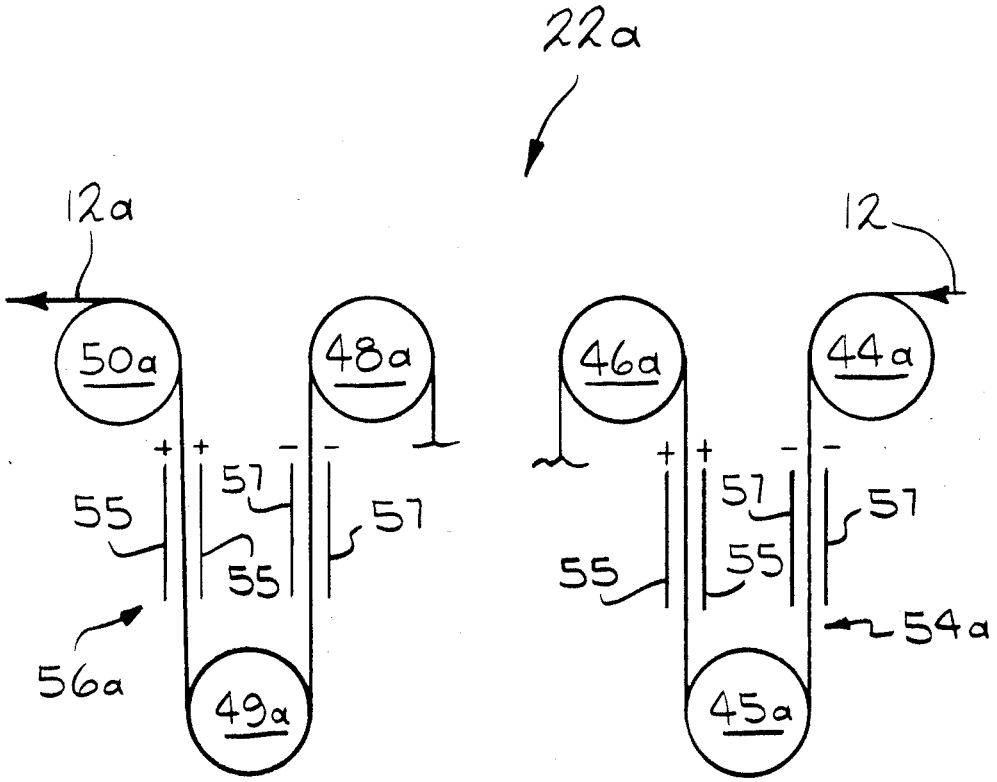
FIG. 3 is a schematic elevation view of an electrolytic pickling unit including our invention.
Figure 4:
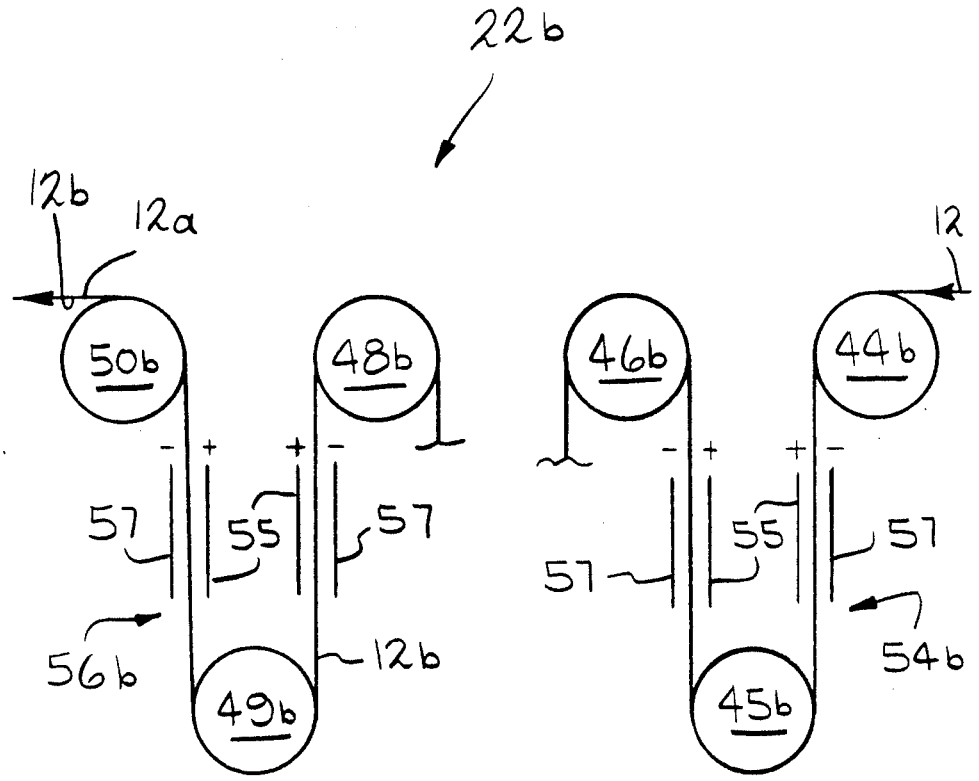
FIG. 4 is a schematic elevation view of a pickling unit including a preferred form of our invention.

FIG. 3 shows an electrolytic pickling unit 22*a* similar to that shown in FIG. 2 except the polarity of each pair of electrodes is reversed. A first pair 54*a* includes cathodes 57 and a last pair 56*a* includes anodes 55. When the last current applied to the non-electroplated surface 12*a* was cathodic, we unexpectedly determined staining and etching of surface 12*a* was dramatically reduced when electroplating surface 12*b*. Furthermore, when a phosphate conversion coating was applied to surface 12*a*, the phosphate covered the entire surface without any uncoated areas with the size of the phosphate crystals being greatly reduced. It would appear cathodic pickling surface 12*a* causes resistance to staining, etching and thereby enhances phosphating characteristics. Apparently, if surface 12*a* is anodically pickled after being cathodically pickled, the aforementioned positive effect is diminished. Accordingly, if multiple electrodes with alternating polarity are used to pickle the non-electroplated strip surface, it is mandatory that the last electrode be an anode. As the results will demonstrate below, it is preferred no anodic current be applied to surface 12*a* as shown in FIG. 4. A pickling unit 22*b* in FIG. 4 is the same as the pickling units in FIGS. 2 and 3 except all the electrodes adjacent surface 12*a* are anodes 55 and the other electrode of each pair is cathode 57. For example, first pair 54*b* includes anode 55 adjacent surface 12*a* and cathode 57 adjacent surface 12*b*. The preferred pickling electrode arrangement in FIG. 4 is referred to as split or bipolarity.

Even though FIGS. 3 and 4 show vertical pickling units having multiple cells, those skilled in the art will understand the principal of our invention would work equally well in a horizontal pickling unit utilizing a single anode positioned adjacent surface 12*a*.

Figure 5:
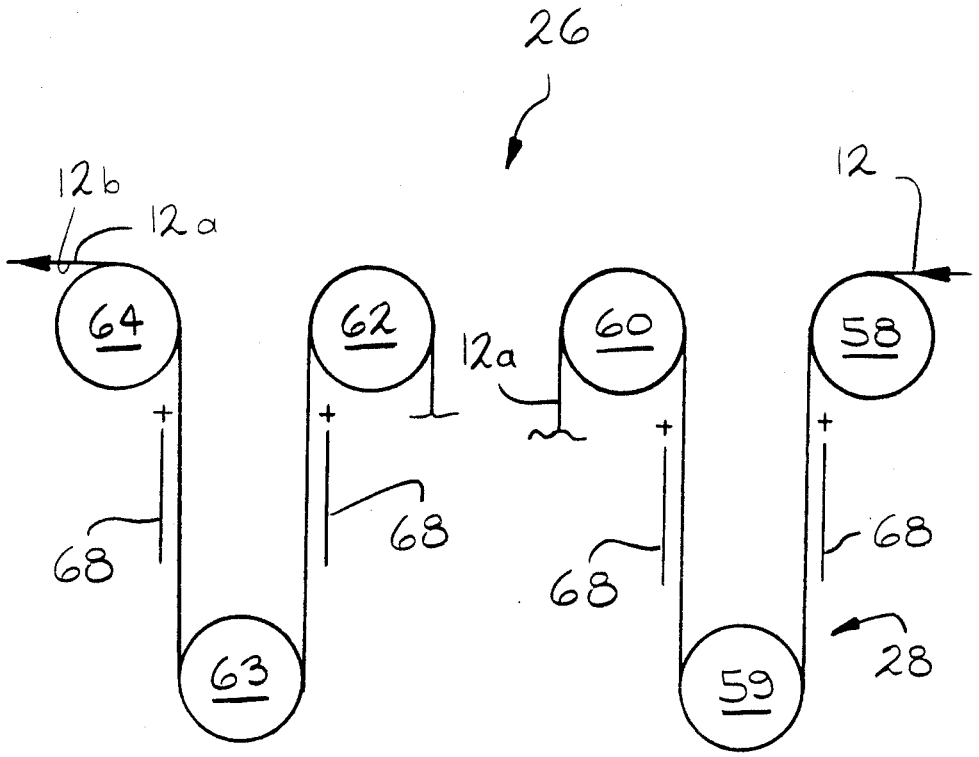
FIG. 5 is a schematic elevation view of vertical plating cells of an electroplating unit.

FIG. 5 shows in detail a portion of electroplating unit 26. Unit 26 is a ARUS-Andritz-Ruthner Gravitel vertical plating unit having sixteen cells. A horizontal plating unit could also be used. As with pickling unit 22, each cell of electroplating unit 26 includes a pair of upper change of direction rollers, a lower change of direction roller, and one or two plating anodes. For two-side electroplating, a pair of opposing anodes would be positioned adjacent the strip at each vertical travel location. For one-side electroplating, the anodes adjacent the surface to remain non-electroplated are displaced away from the strip or removed from each cell. In FIG. 5, cleaned strip 12 enters cell 28 by passing around a roller 58 and surface 12*b* past a plating anode 68. Strip 12 moves around a roller 59 with surface 12*b* passing another anode 68 with strip 12 finally leaving cell 28 after passing around a roller 60. Electrolyte containing a plating metal is cascaded over strip 12 by pumps (not shown). A metallic coating is deposited onto strip surface 12*b* by applying a current to strip surface 12*b* through anodes 68. Strip 12 continues through plating unit 26 and finally exiting the last plating cell which includes upper rollers 62, 64 and a lower roller 63. The exact number of anodes 68 used will depend on the coating weight to be deposited onto surface 12*b* and the current density used. It will be understood if it were desired to produce one-side electroplated strip by plating surface 12*a* rather than surface 12*b*, one merely would withdraw or remove anodes 68 adjacent surface 12*b* shown in FIG. 5 and reposition anodes 68 along the opposite side of strip 12 adjacent surface 12*a*.

Figure 6:
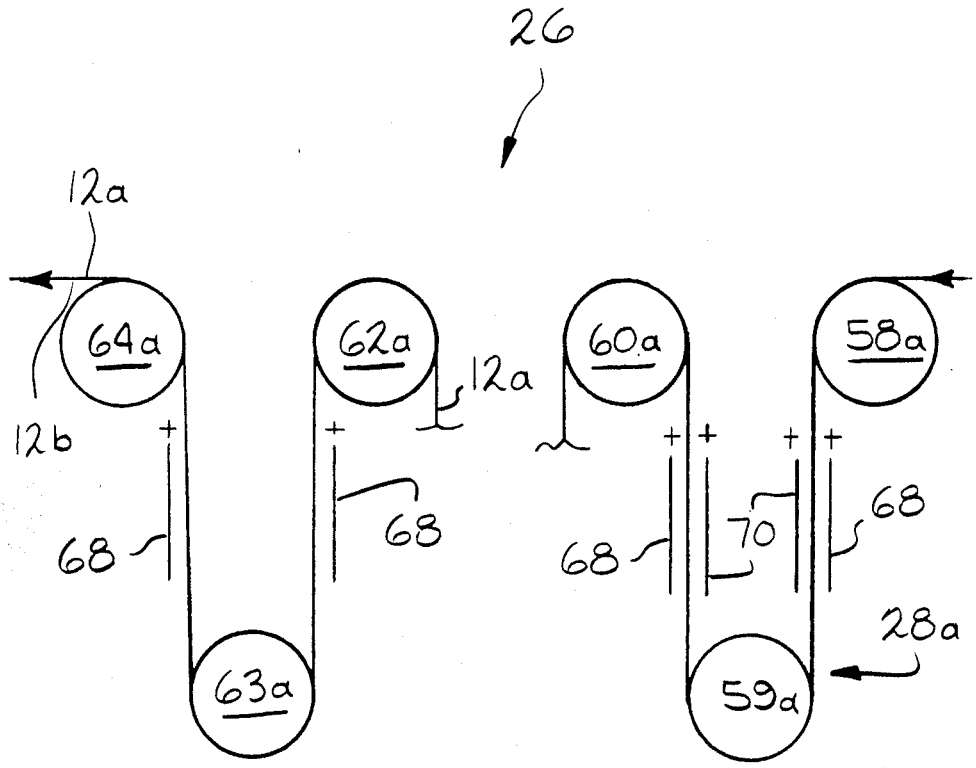
FIG. 6 is a schematic elevation view showing a modified plating cell of the electroplating unit in FIG. 5.

FIG. 6 illustrates another embodiment of our invention for plating unit 26. This plating unit is identical to that in FIG. 5 except an anode 70 in cell 28*a* (the first cell) is repositioned adjacent non-electroplated surface 12*a*. Although it has been determined that prior cathodic pickling at 22*a*, 22*b* virtually eliminated staining of surface 12*a* in plating unit 26, some slight etching still may occur. We prefer to deposit a thin coating metal on non-electroplated surface 12*a* of no greater than 1 $g/m^2$.

At line speeds of less than 300 ft./min (91 m/min), we have determined a coating metal of about 1 g/m$^2$ becomes substantially dissolved about half way through plating unit 26. Accordingly, by plating about 1 g/m$^2$ onto non-electroplated surface 12*a* at cell 28 and again midway through plating unit 26 at a cell 30 (see FIG. 1), surface 12*a* can be protected against etching by the plating electrolyte.

Another enhancement to our invention preferably includes a phosphoric acid rinse of strip 12 after electroplating. Although the phosphating characteristics iof surface 12*a* are good following cathodic pickling, we determined the phosphate crystal size is even further reduced when surface 12*a* is rinsed with a dilute concentration of phosphoric acid. Of course, any wrap-around plating metal remaining on surface 12*a* will also be removed by the phosphoric acid.

By way of example for one-side zinc electroplating, cold rolled low carbon steel strip 12 can be processed on electroplating line 10 at about 300 ft/min (91 m/min). Strip 12 is alkaline cleaned at cleaning unit 18 using one of several well known commercially available cleaners and maintained at a temperature of at least 150° F. (66° C.). A current density of at least about 5 A/dm$^2$- should be used for anodic-cathodic-anodic alternating polarity.

Strip 12 then passes into electrolytic pickler 22*a* or 22*b* containing a solution having 10–100 g/l, preferably about 50 g/l sulfuric acid and maintained at a temperature of at least about 80° F. (27° C.). A current density of at least about 5 A/dm$^2$ should be used.

After non-electroplated surface 12*a* of strip 12 is cathodically pickled, about 20–100 g/m$^2$ of zinc coating metal is plated onto surface 12*b* of strip 12. The typical electrolyte used in plating unit 26 includes 100–120 g/l $Zn++$, 5–10 g/l sulfuric acid, 1–3 g/l aluminum sulfate ($Al_2(SO_4)_3.18H_2O$), a pH of 1.5 and be maintained at a temperature of at least about 120° F. (49° C.) A current density of about 50–140 A/dm$^2$ should be used.

After being electroplated, strip 12 is preferably rinsed at rinsing unit 36 in a solution of 10–70 g/l, preferably 30 g/l of phosphoric acid. Finally, strip 12 or parts fabricated therefrom are phosphated using a conversion coating solution.

Samples were cleaned, pickled, electrolytically rinsed and phosphated to evaluate the phosphating characteristics. Results of the various types of pickling are shown in Table I.

TABLE I

| Sample | Pickling Procedure | Electrolyte Exposure | Metal Appearance (8) | Phosphate Crystals Microns (9) | Phosphate Crystals % Coverage |
|---|---|---|---|---|---|
| OS-8 | Control (1) | none | Bright | 7–10 | 100 |
| OS-68 | Control (2) | none | Bright | 10 | 100 |
| OS-10 | Non-electrolytic | 10 seconds (6) | Bright | 80 | 85 |
| OS-11 | Non-electrolytic | 10 seconds (7) | Slightly Etched | 55 | 80 |
| OS-29 | Anodic | 10 seconds (6) | V Dark | 30 | 50 |
| OS-31 | Anodic | 10 seconds (7) | V Dark | 40 | 50 |
| OS-4 | ACA (3) | 10 seconds (6) | V Dark-Etched | 60 | 55 |
| OS-6 | ACA (3) | 10 seconds (7) | V Dark-Etched | 30 | 85 |
| OS-20 | ACA (3) | 60 seconds (6) | V Dark-Etched | 45 | 80 |
| OS-22 | ACA (3) | 60 seconds (7) | V Dark-Etched | 70 | 95 |
| OS-3 | CAC (4) | 10 seconds (6) | V Dark-Etched | 35 | 100 |
| OS-5 | CAC (4) | 10 seconds (7) | V Dark-Etched | 30 | 100 |
| OS-21 | CAC (4) | 60 seconds (6) | V Dark-Etched | 15–20 | 100 |
| OS-23 | CAC (4) | 60 seconds (7) | V Dark-Etched | 20 | 100 |
| OS-28 | Cathodic (5) | 10 seconds (6) | Bright | 5–10 | 100 |
| OS-30 | Cathodic (5) | 10 seconds (7) | V Dark | 10–15 | 90 |
| OS-18 | Cathodic (5) | none | Bright | 10 | 100 |

Notes:
(1) Nonpickled cold rolled sample.
(2) Nonpickled one-side hot dipped galvanized. (U.S. Pat. No. 4,082,868)
(3) Pickling procedure was anodic-cathodic-anodic.
(4) Pickling procedure was cathodic-anodic-cathodic.
(5) Bipolarity pickling with the non-electroplated side cathodically pickled.
(6) Following pickling, sample exposed to electrolyte for specified time.
(7) Following pickling, sample exposed to electrolyte containing $\geqq 5$ g/l $Fe+++$ for specified time.
(8) Visual observations pertain to non-electroplated strip surface prior to phosphating.
(9) Crystal size as measured by a scanning electron microscope.

From the above, those samples only anodically pickled resulted in only about a 50% phosphate coverage of the surface area with the crystals being 30 microns or larger. Those samples receiving an anodic, cathodic, anodic pickling procedure were roughened by etching, had less than satisfactory phosphate coverage, and had very large phosphate crystals. Those samples receiving a cathodic, anodic, cathodic pickling had a roughened surface, marginal to good phosphate crystal size, and complete phosphate coverage. As indicated above, etching on these samples could have been prevented by plating 1 g/m$^2$ onto the non-electroplated surface in the first cell 28 in plating unit 26 to protect the non-electroplated surface 12*a* from the electrolyte. Furthermore, as demonstrated below, rinsing these samples in phosphoric acid prior to phosphating would have somewhat reduced the crystal size, particularly samples OS-3 and OS-5. Finally, the last two samples which were only cathodically pickled were not etched, had a small phosphate crystal size and had good phosphate coverage. Sample OS-30 is believed to have less than 100% phosphate coverage because the electrolyte had excessive dissolved iron. Other experiments, not shown here, demonstrated dissolved iron above about 2 g/l is detrimental to phosphatability.

Table II below shows the effect of various post-treatments on the phosphating results of one-side electroplated strip exhibiting poor phosphatability due to the aforementioned processing i.e. anodic pickling and/or contact with the electrolyte solution.

TABLE II

| Sample | Rinse Treatment | Microns | % Coverage |
|---|---|---|---|
| 1 | Control - No Treatment | 25 | 70 |
| 2 | Oxalic Acid (3 Wgt %) | 20–25 | 75 |

TABLE II-continued

| Sample | Rinse Treatment | Microns | % Coverage |
|---|---|---|---|
| 3 | Oxalic Acid (3 Wgt %)-Brushed | 15–20 | 75 |
| 4 | Malonic Acid (4 Wgt %) | 20–25 | 75 |
| 5 | Malonic Acid (4 Wgt %)-Brushed | 20 | 70 |
| 6 | Citric Acid (1 Wgt %) | 20 | 75 |
| 7 | Citric Acid (1 Wgt %)-Brushed | 15 | 85 |
| 8 | Butanol | 15–20 | 80 |
| 9 | Butanol-Brush | 10–15 | 95+ |
| 10 | Brush Only | 20 | 70 |
| 11 | Phosphoric acid (3 Wgt %) | 15 | 100 |
| 12 | Phosphoric acid (3 Wgt %)-Brush | 15–20 | 95+ |

The above results show that a diluted phosphoric acid rinse (samples 11 and 12) of the non-electroplated surface gave outstanding results compared to sample 1 which was not treated after electoplating. Good results were also obtained with butanol and brushed butanol. However, the unpleasant odor of butanol and maintenance problems associated with brushes preclude their usage. It should be noted the treatments applied to samples 2–9 are all disclosed in the above-referenced U.S. Pat. No. 4,632,733 as allegedly enhancing phosphating characteristics.

Various modifications can be made to our invention without departing from the spirit and scope of it. For example, a horizontal or vertical unit could be used for the pickler or plating unit. One or more anodes could be used in either the pickler or plating unit depending on the type unit used and current density applied to the strip. Various types and weights of plating metal and conversion coatings may be used. Therefore, the limits of our invention should be determined from the appended claims.

We claim:

1. A method of making a one-side electroplated steel strip on a coating line, the non-electroplated side of the strip having good chemical conversion coating characteristics, the coating line including an electrolytic pickler and a plating unit, the pickler including a pickling anode, the plating unit including a plating anode, an electrolyte, and a plating metal dissolved in the electrolyte, comprising the steps of:

passing the non-electroplated side of a strip adjacent said pickling anode in said pickler, applying a current through said pickling anode to cathodically pickle said non-electroplated side of said strip, passing said strip through said plating unit, applying a current through said plating anode to deposit said plating metal on the elctroplated side of said strip, whereby said cathodically pickled surface resists staining and etching by said electrolyte.

2. The method of claim 1 wherein a current density of at least about 5 $A/dm^2$ is passed through said pickling anode.

3. The method of claim 1 wherein a current density of at least about 50 $A/dm^2$ is passed through said plating anode.

4. The method of claim 1 wherein said pickler includes 10–100 g/l acid.

5. The method of claim 4 wherein said acid is sulfuric.

6. The method of claim 1 including a plurality of said plating anodes, one of said plating anodes adjacent said non-electroplated side, passing a current of at least about 50 $A/dm^2$ through said plating anode adjacent said non-electroplated side, depositing a plating metal of at least about 1 $g/m^2$ to said non-electroplated side.

7. The method of claim 1 including an additional step of passing said electroplated strip through phosphoric acid.

8. The method of claim 7 wherein the concentration of said phosphoric acid is 10–70 g/l.

9. The method of claim 1 including the additional step of rinsing said non-electroplated side with a conversion coating.

10. The method of claim 9 wherein said conversion coating is phosphate.

11. The method of claim 10 wherein the phosphate crystals of said conversion coating are no greater than about 25 microns.

12. The method of claim 1 wherein said pickler has a plurality of pickling anodes, said non-electroplated surface of said strip passing adjacent to said pickling anodes, applying a current through said pickling anodes to cathodically pickle said non-electroplated side of said strip.

13. A method of making a one-side elctroplated steel strip on a coating line, the non-electroplated side of the strip having good chemical conversion coating characteristics, the coating line including a vertical pickler and a plurality of vertical plating cells, the pickler having a plurality of pickling anodes, each plating cell including a plating anode, an electrolyte, and zinc dissolved in the electrolyte, at least one of the plating cells including a pair of opposing plating anodes, comprising the steps of:

passing the non-electroplated side of a strip adjacent said pickling anodes in said pickler, applying a current through said pickling anodes to cathodically pickle said non-electroplated side of said strip, passing said strip through said plating cells, applying a current through said plating anodes to deposit a zinc coating layer on the electroplated side of said strip, rinsing said non-electroplated side of said electroplated strip with phosphoric acid, rinsing said non-electroplated surface with a phosphate conversion solution, the phosphate crystals of the conversion coating formed on said non-electroplated surface having a size no greater than about 25 microns, whereby said cathodically pickled surface resists staining and etching by said electrolyte.

* * * * *